US005487657A

United States Patent [19]

Fairbanks et al.

[11] Patent Number: 5,487,657

[45] **Date of Patent: * Jan. 30, 1996**

[54] SELECTIVELY ACTUATABLE LIGHTER

[75] Inventors: Floyd B. Fairbanks, Naugatuck; Thomas G. Snell, Madison; James M. McDonough, Guilford, all of Conn.

[73] Assignee: BIC Corporation, Milford, Conn.

[ * ] Notice: The portion of the term of this patent subsequent to Mar. 26, 2008, has been disclaimed.

[21] Appl. No.: 71,863

[22] Filed: Jun. 3, 1993

Related U.S. Application Data

[63] Continuation of Ser. No. 912,421, Jul. 10, 1992, abandoned, which is a continuation of Ser. No. 609,668, Nov. 6, 1990, abandoned, which is a continuation of Ser. No. 239,734, Sep. 2, 1988, Pat. No. 5,002,482.

[51] Int. Cl.[6] ..... F23D 11/36

[52] U.S. Cl. ..... 431/153; 431/277; 431/255; 222/402.11; 222/153.14

[58] Field of Search ..... 431/153, 277, 431/344, 255; 222/153, 402.11; 251/9, 102

[56] References Cited

U.S. PATENT DOCUMENTS

| | | | |
|---|---|---|---|
| 1,895,032 | 1/1933 | Fisher . | |
| 2,520,328 | 8/1950 | Nissen | 67/7.1 |
| 2,637,577 | 5/1953 | Wiessner | 292/122 |
| 2,727,376 | 12/1955 | Felt | 67/7.1 |
| 2,806,520 | 9/1957 | Adams | 158/73 |
| 3,169,672 | 2/1965 | Soffer et al. | 222/153 |
| 3,194,435 | 7/1965 | Burchett | 222/3 |
| 3,213,647 | 10/1965 | Sakamoto | 67/7.1 |
| 3,267,988 | 8/1966 | Schott | 158/73 |
| 3,450,143 | 6/1969 | Tamarin | 137/38 |
| 3,547,566 | 12/1970 | Tamarin | 431/88 |
| 3,601,165 | 8/1971 | Obata | 141/302 |
| 3,612,736 | 10/1971 | Steuernagel et al. | 431/130 |

(List continued on next page.)

FOREIGN PATENT DOCUMENTS

| | | | |
|---|---|---|---|
| 296281 | 12/1988 | European Pat. Off. | F23Q 2/16 |
| 2198092 | 3/1974 | France | F23Q 2/00 |
| 2220047 | 9/1974 | France | F23Q 2/42 |
| 2307224 | 11/1976 | France | 431/125 |
| 2633702 | 1/1990 | France | F23Q 2/34 |
| 52117197 | 2/1979 | Japan . | |
| 56-32749 | 8/1981 | Japan | 431/153 |

OTHER PUBLICATIONS

Confidential Disclosure Agreement.

Federal Register, vol. 57, No. 159, pp. 36929–36964 (Aug. 17, 1992).

*Primary Examiner*—Carl D. Price

*Attorney, Agent, or Firm*—Pennie & Edmonds

[57] ABSTRACT

A child resistant lighter device is disclosed which includes a body defining reservoir for containing a combustible gaseous medium such as butane, and having a valve arranged to be selectively actuated between a normally closed position and an open position which permits the exit of the gaseous medium. Such child resistant lighter can selectively produce sparks at a location proximate to the gaseous medium exit to ignite the gaseous medium, and a safety mechanism prevents actuation of the valve to the open position when sparks are produced. Such child resistant lighter device embodies a resiliently releasable safety latch which prevents the actuation of the valve actuator to the open position. The safety latch is selectively movable to a position out of interference with the valve actuator, so that the gaseous medium may be released and ignited by the sparks. The safety latch is resiliently structured and mounted such that once a flame is produced and the valve actuator is released, the safety latch returns to its closed or locked position to prevent actuation of the valve actuator to the open position by prevention of the pivotal motion. To "re-use" the lighter, the safety-latch must again be moved to the open or unlocked position so that the valve actuator can be opened for subsequent ignition of the gaseous medium. Such mechanism is difficult for a young child to light, but is capable of actuation by adults.

10 Claims, 4 Drawing Sheets

U.S. PATENT DOCUMENTS

| | | | |
|---|---|---|---|
| 3,723,048 | 3/1973 | Russell | 431/151 |
| 3,744,953 | 7/1973 | Herr | 431/13 |
| 3,749,286 | 7/1973 | Douglas | 222/153 |
| 3,752,637 | 8/1973 | Norman et al. | 431/274 |
| 3,756,766 | 9/1973 | Green | 431/254 |
| 3,816,056 | 6/1974 | Brown | 431/253 |
| 3,817,693 | 6/1974 | Sebens et al. | 431/153 |
| 3,828,982 | 8/1974 | Steigerwald | 222/153 |
| 3,885,717 | 5/1975 | Ewald | 222/402.11 |
| 3,898,031 | 8/1975 | Rusakowicz | 431/130 |
| 3,899,285 | 8/1975 | Christmas | 431/152 |
| 3,899,286 | 8/1975 | Lockwood et al. | 431/321 |
| 3,904,088 | 9/1975 | Milbourne, Sr. | 222/402.11 |
| 3,910,752 | 10/1975 | Holl | 431/273 |
| 3,918,614 | 11/1975 | Steiman | 222/153 |
| 3,938,943 | 2/1976 | Malamoud | 431/150 |
| 3,940,023 | 2/1976 | Umstead | 222/153 |
| 3,955,585 | 5/1976 | Fox | 131/186 |
| 3,963,413 | 6/1976 | Lockwood et al. | 431/276 |
| 3,966,392 | 6/1976 | Lockwood | 431/344 |
| 3,984,665 | 7/1975 | Swenson | 222/402.11 |
| 3,985,493 | 10/1976 | Neyret | 431/150 |
| 4,003,694 | 1/1977 | Lowell | 431/344 |
| 4,008,992 | 2/1977 | Johnsson | 431/344 |
| 4,024,988 | 5/1977 | Starrett | 222/153 |
| 4,028,043 | 6/1977 | Neyret | 431/144 |
| 4,036,579 | 8/1977 | Marynissen | 431/131 |
| 4,049,370 | 9/1977 | Neyret | 431/144 |
| 4,102,633 | 7/1978 | Zellwegger et al. | 431/152 |
| 4,111,638 | 9/1978 | Ostberg | 431/13 |
| 4,150,940 | 4/1979 | Heller et al. | 431/130 |
| 4,181,490 | 1/1980 | Nitta | 431/129 |
| 4,190,412 | 2/1980 | Nitta | 431/151 |
| 4,324,351 | 4/1982 | Meshberg | 222/402.11 |
| 4,403,945 | 9/1983 | Leitgib | 431/150 |
| 4,413,638 | 11/1983 | Le | 131/174 |
| 4,416,612 | 11/1983 | Tabata | 431/131 |
| 4,432,542 | 2/1984 | Poynter | 272/27 W |
| 4,457,699 | 7/1984 | Hattori | 431/344 |
| 4,487,570 | 12/1984 | Lowenthal | 431/130 |
| 4,522,583 | 6/1985 | Kraser | 431/126 |
| 4,717,335 | 1/1988 | Loveless | 431/277 |
| 4,758,152 | 7/1988 | Kordecki | 431/153 |
| 4,773,849 | 9/1988 | Schachter | 431/344 |
| 4,784,601 | 11/1988 | Nitta | 431/153 |
| 4,784,602 | 11/1988 | Nitta | 431/153 |
| 4,786,248 | 11/1988 | Nitta | 431/255 |
| 4,799,877 | 1/1989 | Bisbee | 431/153 |
| 4,810,187 | 3/1989 | Nitta | 431/255 |
| 4,822,276 | 4/1989 | Bisbee | 431/153 |
| 4,830,603 | 5/1989 | Cirami | 431/153 |
| 4,832,596 | 5/1989 | Morris, Sr. | 431/153 |
| 4,844,244 | 7/1989 | Mawby | 206/88 |
| 4,844,254 | 7/1989 | Jang | 206/236 |
| 4,846,667 | 7/1989 | Lin | 431/151 |
| 4,850,854 | 7/1989 | Buck | 431/143 |
| 4,854,859 | 8/1989 | Lin | 431/344 |
| 4,859,172 | 8/1989 | Nitta | 431/153 |
| 4,859,174 | 8/1989 | Zellweger et al. | 431/255 |
| 4,869,663 | 9/1989 | Fremund | 431/153 |
| 4,889,482 | 12/1989 | Schachter | 431/344 |
| 4,904,180 | 2/1990 | Nitta | 431/153 |
| 4,921,420 | 5/1990 | Johnston | 431/153 |
| 5,002,482 | 3/1991 | Fairbanks et al. | 251/108 X |
| 5,035,608 | 7/1991 | Darren | 431/277 X |

FIG. 4
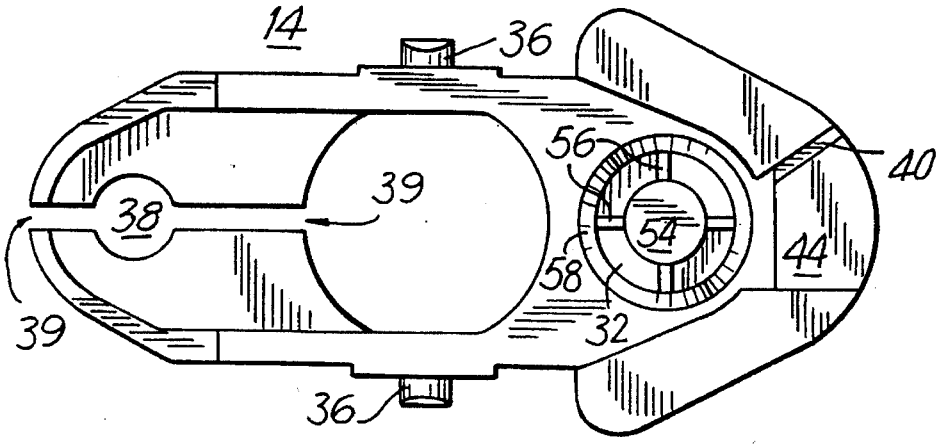
FIG. 5
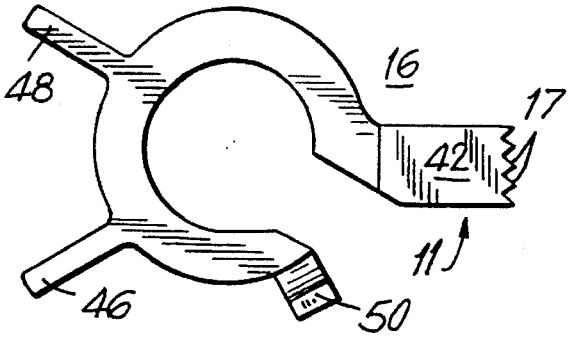
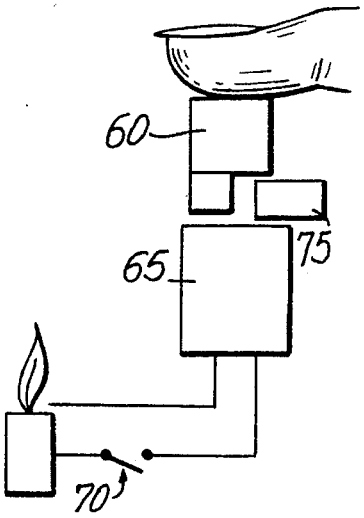
FIG. 6
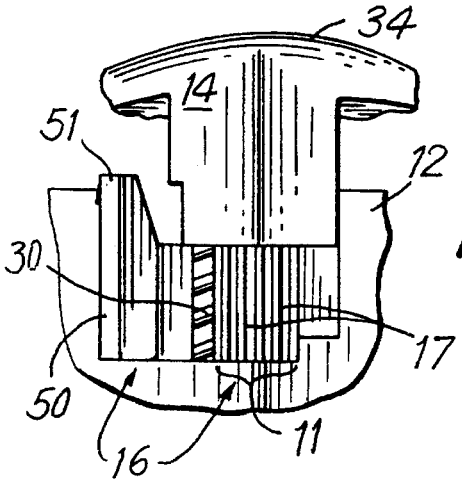
FIG. 9

SELECTIVELY ACTUATABLE LIGHTER

This is a continuation of application Ser. No. 07/912,421, filed Jul. 10, 1992, now abandoned, which is a continuation of application Ser. No. 07/609,668, filed Nov. 6, 1990, abandoned, which is a continuation of application Ser. No. 07/239,734 filed Sep. 2, 1988 entitled "SELECTIVELY ACTUATABLE LIGHTER", now U.S. Pat. N. 5,002,482.

BACKGROUND OF THE INVENTION

1. Technical Field

This invention relates generally to lighters which consume fuel such as, for example, butane by converting the fuel to a gaseous state and thereafter burning the fuel. More particularly the invention relates to a disposable butane cigarette lighter having a safety mechanism which prevents a valve actuator from being depressed and in turn prevents a valve nozzle from expelling butane thereby rendering operation of the lighter by young children difficult.

2. Description of the Prior Art

Various prior art lighters, some of them incorporating safety features, are known. Safety features are generally provided to reduce the risk of injury to an operator or bystanders. Some of such safety features relate to mechanisms which prevent ignition of a fuel source unless the lighter is properly oriented, mechanisms which automatically turn off a fuel source supply valve and tamper protection arrangements.

More recently, attention has been directed toward preventing ready actuation of such lighters by persons normally not able to appreciate the potential danger of the flame. Such danger includes the potential to burn the individual directly or to burn surrounding areas or items, thus creating the possibility of spreading to a fully developed fire. Individuals normally contemplated in these efforts are small children, mostly in the age category of five years or younger.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby operating the lighter and causing the fuel to ignite. Rotation of the spark-producing wheel in the other direction may deliver a spark away from the nozzle. The spark-producing wheel has a pin-shaped structure attached thereto which serves to limit the rotation of the wheel to under 360~ by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

In this lighter the pin-shaped structure may not have necessarily traversed its entire path of travel when the lighter is operated, in which case subsequent operation of the lighter may ignite the fuel source, presenting potential for multiple ignitions. Furthermore, even if the pin-shaped structure has traversed its entire path of travel, a young child may still ignite the fuel source by inadvertently first rotating the spark-producing wheel in a direction so as to not produce sparks in the vicinity of the nozzle and then rotating the wheel in an opposite direction so as to produce sparks in the vicinity of the nozzle and igniting the fuel. Additionally, regardless of the position of the wheel, potential exists for releasing fuel from the fuel source with or without rotation of the wheel.

U.S. Pat. Nos. 4,028,043 and 4,049,370 each to Neyret relate to presale tamper protection mechanisms which partially surround a spark-producing wheel, fuel nozzle or depressable valve actuation member of a lighter. These presale tamper protection mechanisms are attached to the lighter housing by frangible webs and are removed by a purchaser after sale of the lighter to expose the spark-producing wheel, fuel nozzle and depressable valve actuation member. However, such a presale tamper protection mechanism is of limited value once initially removed by a purchaser.

U.S. Pat. Nos. 3,547,566 to Tamarin and 3,899,286 to Lockwood et al. relate to lighters having orientation sensing mechanisms which hinder or prevent actuation of the lighter in an inverted position. Unfortunately such mechanisms may not provide a sufficient degree of safety to young children who tamper with the lighter since they merely hinder operation in prescribed orientations.

In addition to the above-mentioned disadvantages and deficiencies, some safety mechanisms are unnecessarily complicated and may therefore suffer from high manufacturing cost as well as high likelihood of mechanical failure during use. Another disadvantage found in some of these devices is that the particular construction employed limits the shape of the lighter housing due to the requirement that the housing be large enough to accommodate the safety mechanism(s).

Although it is known to prevent or hinder presale actuation of a depressable valve actuation member or actuation of a lighter in a specified orientation, none of the above-described lighters provides a mechanism for preventing actuation of the depressable valve actuation member as the lighter is carried, stored or subjected to tamper. Prevention of the expulsion of fuel through the nozzle under such circumstances is a highly desirable feature since ignition may be provided by other sources in addition to the spark-producing wheel.

Although current efforts as described herein may sometimes be referred to as "child-proof lighters", "child-resistant lighters" or the like, it should be made clear that such developments are actually directed toward preventing ready flame production on a flame producing lighter by persons normally considered incapable of appreciating the potential danger of a lighter flame.

Consistent with such efforts is the recognition that to develop a "child-proof" lighter per se, would not be viable. At best it can be reasonably sought to create a lighter which is "child-resistant", but how "child-resistant" a lighter will be will depend upon related factors and circumstances. For example, it is known that lighters are specifically designed to produce a flame. Accordingly, if the lighter were to come into the possession of a person incapable of appreciating the potential danger of the flame a potentially dangerous situation will prevail. This situation would be independent of the operating condition of the lighter and would prevail even if the lighter is in perfect working order. Further, in many instances lighters contain clear written warnings prominently displayed on their surface and without proper supervision, a young child who gains possession of the lighter can cause harm by the fact that the warning will not be appreciated since it cannot be read and/or understood by the child. Accordingly, "child-resistant" efforts are best directed toward protecting the child from its own acts should the child come into possession of a lighter with or without the parents' knowledge or consent. The potential danger would prevail even if the lighter is a properly functioning lighter and has a clear warning displayed thereon advising the user to keep the lighter out of the reach of children.

Nevertheless, any such "child-resistant" lighter will have its limitations with respect to young children, and no such lighter should provide parents or adults with a false sense of security so that they may become less cautious in their handling or as to permitting ready access by young children. Further, such lighters should not be made so difficult to light as to cause adults to use alternative forms of lighting, i.e., matches, which are generally considered to be potentially more dangerous. At best, the lighter should provide a young child with sufficient deterrent features as to prevent it from readily producing a flame on the lighter or to deter it from readily producing a flame, at least for a time sufficient to permit the normally expected intervention of adult supervision.

The present invention is directed toward a flame producing lighter which is selectively actuatable in such a manner as to provide a substantial degree of difficulty for young children—mostly five years or younger—to actuate the lighter and produce a flame, while being capable of actuation by adults.

SUMMARY OF THE INVENTION

The invention relates to a flame producing lighter which comprises a housing defining reservoir for containing a combustible gaseous medium under pressure, valve meals arranged for selective actuation between a normally closed position which prevents exit of the gaseous medium from the reservoir, and an open position which permits exit of gaseous medium from the reservoir through the valve means means for selectively producing sparks at a location proximate the gaseous medium exit opening of the valve means thereby selectively causing ignition of the gaseous medium, means for preventing actuation of the valve means to the open position and means for selectively permitting actuation of the valve means to the open position thereby selectively permitting exit of the combustible gaseous medium from the valve means and ignition of the gaseous medium by sparks produced by the spark-producing means.

In a preferred embodiment the valve means is actuated to the open position by actuator means and the means for preventing actuation of the valve means to the open position comprises means for preventing pivotal movement of the actuator means by interference with the movement thereof. The valve actuation interference means is selectively movable to a position out of interference with the valve actuator means.

The valve actuation interference means is normally retained in a valve actuation interference position and the movement thereof to the position out of interference with the valve actuator means is resiliently provided. The resilient movement of the valve actuation interference means causes the valve actuation interference means to return to its position beneath the valve actuator once the valve actuator is released, thus preventing the valve nozzle from opening. In particular, the valve actuation interference means is a safety latch moveable cross-wise and upwards towards a guide notch in the valve actuator until the valve actuator is depressed, whereby gaseous material exits and the safety latch moves back under the valve actuator widen the valve actuator is released.

The means for selectively producing sparks preferably comprises flint material and a rotatable spark-producing wheel having a toothed surface positioned and arranged to selectively frictionally contact the flint material. Alternatively, the means for selectively producing sparks may comprise electric spark-producing means and more specifically, piezoelectric spark-producing means.

A fuel cutoff safety mechanism is disclosed for use in combination with a lighter comprising means for preventing actuation of a fuel supply under normal circumstances and means for selectively permitting actuation of the fuel supply, wherein such selective actuation of the fuel supply and a corresponding production of sparks by spark-producing means ignites fuel from the fuel supply.

Means for selectively permitting actuation of the fuel supply is provided and comprises a depressable valve actuator which, upon depression, actuates the fuel supply thereby permitting fuel to flow out from the fuel supply and a safety latch which normally prevents depression of the depressable valve actuator, wherein application of a biasing force to the safety latch permits depression of the valve actuator.

A portion of the safety latch is normally positioned between the valve actuator and a main body housing of the lighter and prevents depression of the valve actuator. Cross-wise movement of the safety latch provides a void between the valve actuator and the main body housing, the void being sufficient in size to enable the valve actuator to be depressed at least partially into the void. Upwards movement, subsequent to the cross-wise movement, of the safety latch towards a position at least partially adjacent to the valve actuator, the position being resiliently maintained by pressure exerted by the safety latch on the valve actuator and the main body housing, provides the lighter in an unlocked position in which the valve actuator is capable of being depressed, thereby permitting fuel to flow.

A flame developing lighter is also disclosed which comprises a housing, fuel supply means for supplying fuel to be ignited, ignition means for igniting fuel, valve means for selectively permitting flow of the fuel and means for selectively unlocking the lighter from a normally locked configuration in which fuel is prevented from flowing.

A valve actuator is included which normally prevents escape of the fuel supply when in a first position and is depressable to a second position which permits actuation of the fuel supply means thereby permitting fuel to flow out from the fuel supply means. A safety latch is provided which normally prevents depression of the depressable valve actuator, wherein selective application of a biasing force by the operator to the safety latch permits depression of the valve actuator.

An improved flame producing lighter is also disposed of the type having a housing, a fuel supply, a valve means for selectively supplying fuel from the fuel supply to a fuel nozzle and spark-producing means for producing sparks, wherein the improvement comprises means for selectively permitting actuation of the valve means thereby selectively permitting exit of fuel from the fuel supply through the valve means and ignition of the fuel by sparks produced by the spark-producing means.

Means for selectively permitting actuation comprises locking means. In particular, the locking means comprises pivotally mounted actuator means having an unlocked position and a locked position and means for preventing pivotal movement of the actuator means from the locked position to the unlocked position by interference with the movement thereof, wherein depression of the actuator means in the unlocked position provides fuel flow. The means for preventing pivotal movement preferably comprises a safety latch moveable cross-wise and upwards towards a guide notch in the actuator means until the actuator means is capable of being depressed.

The invention also relates to a flame developing lighter comprising a housing, fuel supply means for supplying fuel to be ignited, ignition means for igniting fuel in sequential advancing steps, valve means for selectively permitting flow of the fuel and control means for preventing the combination of production of fuel flow and spark generation so as to prevent production of a flame and for permitting substantially simultaneous production of fuel flow and spark generation to produce a flame.

The control means preferably comprises a valve actuator which normally prevents escape of the fuel from the fuel supply when in a first position and is depressable to a second position which permits actuation of the fuel supply means thereby permitting fuel to flow out from the fuel supply means. A safety latch is provided which normally prevents depression of the depressable valve actuator, wherein selective application of a biasing force by the operator to the safety latch permits depression of the valve actuator.

The invention also relates to a flame producing lighter resistant to unauthorized use and normally maintained in a locked configuration comprising a housing, fuel supply means for supplying fuel to be ignited, ignition means for igniting fuel, valve means for controlling the flow of tile fuel, a valve actuator which normally prevents escape of the fuel supply when in a first position and is depressable to a second position which permits actuation of the fuel supply means thereby permitting fuel to flow out from the fuel supply means, a safety latch having a portion normally positioned between the valve actuator and the housing which normally prevents depression of the depressable valve actuator and normally maintains the lighter in the locked configuration, wherein cross-wise movement of the safety latch provides a void between the valve actuator and the housing, the void being sufficient in size to enable the valve actuator to be depressed at least partially into the void, and wherein upwards movement, subsequent to the cross-wise movement, of the safety latch towards a position at least partially adjacent to the valve actuator, the position being resiliently maintained by pressure exerted by the safety latch on the valve actuator and the housing, provides the lighter in the unlocked configuration in which the valve actuator is capable of being depressed, thereby permitting fuel to flow.

Advantageously, if the lighter is left unattended a young child or other such person will encounter difficulty in releasing any gaseous material to produce a flame due to the locking action of the safety latch and the effort required to move it cross-wise and upwards towards the unlocked position. Thus, in the event the lighter inadvertently comes into the possession of a young child, the child may be able to turn tile spark-producing wheel but will, at best, only be able to produce sparks from the spark-producing wheel by rotating it against the flint. Gaseous material will not be released due to the action of the safety latch which directly prevents the valve actuator from being depressed thereby preventing the valve nozzle from expelling fuel.

Operation of the lighter requires a certain amount of dexterity and the application of concentrated forces as well as the application of a plurality of forces in multiple directions. Advantageously, these factors tend to render the lighter difficult to operate by young children.

Furthermore, the lighter of the present invention is a passive locking lighter. Advantageously, the lighter automatically returns to its locked configuration once the depressed valve actuator is released. Thus, the lighter is maintained in an at-rest configuration which is locked thereby preventing the production of a flame.

BRIEF DESCRIPTION OF THE DRAWINGS

These and other objects, features, and advantages of the present invention will become more readily apparent from the following detailed description of the invention in which:

FIG. 4 is a bottom view along line 4—4 of the valve actuator depicted in FIG. 3;

FIG. 5 is a top view along line 5—5 of the safety latch depicted in FIG. 4;

FIG. 6 is a schematic diagram depicting a piezoelectric lighter apparatus in which the present invention may be employed and having an optional switch to prevent the production of sparks;

FIG. 9 is a frontal view of the safety latch in its locked position thereby preventing depression and actuation of the valve actuator;

DETAILED DESCRIPTION OF THE PREFERRED EMBODIMENTS

Figure 1:
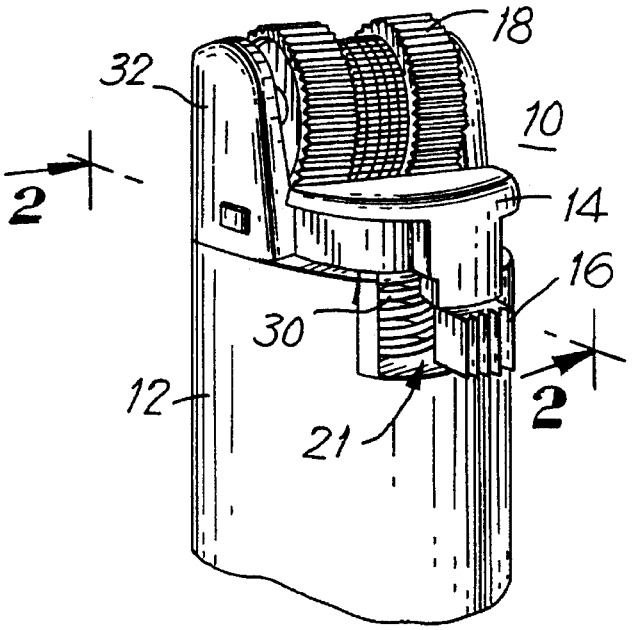
FIG. 1 is a perspective view of a preferred embodiment of a selectively actuatable child resistant lighter of the present invention in a locked position.

Referring initially to FIG. 1, there is depicted, in an at-rest or locked position, the lighter of the present invention comprising a main body portion 12, a depressable valve actuator 14, a safety latch 16 and a spark-producing wheel 18. Depression of valve actuator 14 permits fuel to flow through a fuel nozzle (not shown) and to be ignited by sparks produced by spark-producing wheel 18 frictionally engaging a flint (not shown). Advantageously, unless safety latch 16 is positioned away from its depicted at-rest position and into a notch formed within valve actuator 14, any attempted depression of valve actuator 14 will not result in the flow of fuel and the lighter will be inoperable. The position of safety latch 16 as shown in FIG. 1 may best be characterized as a "default position" under normal conditions.

A user typically holds the main body portion of a lighter in his hand, rotates with his thumb the spark-producing wheel in a direction toward the valve actuator to produce a spark, while depressing the valve actuator to allow fuel to pass through the valve nozzle. The spark produced by the wheel ignites the fuel. This is a relatively conventional structure for most lighters, including disposable lighters.

Figure 2:
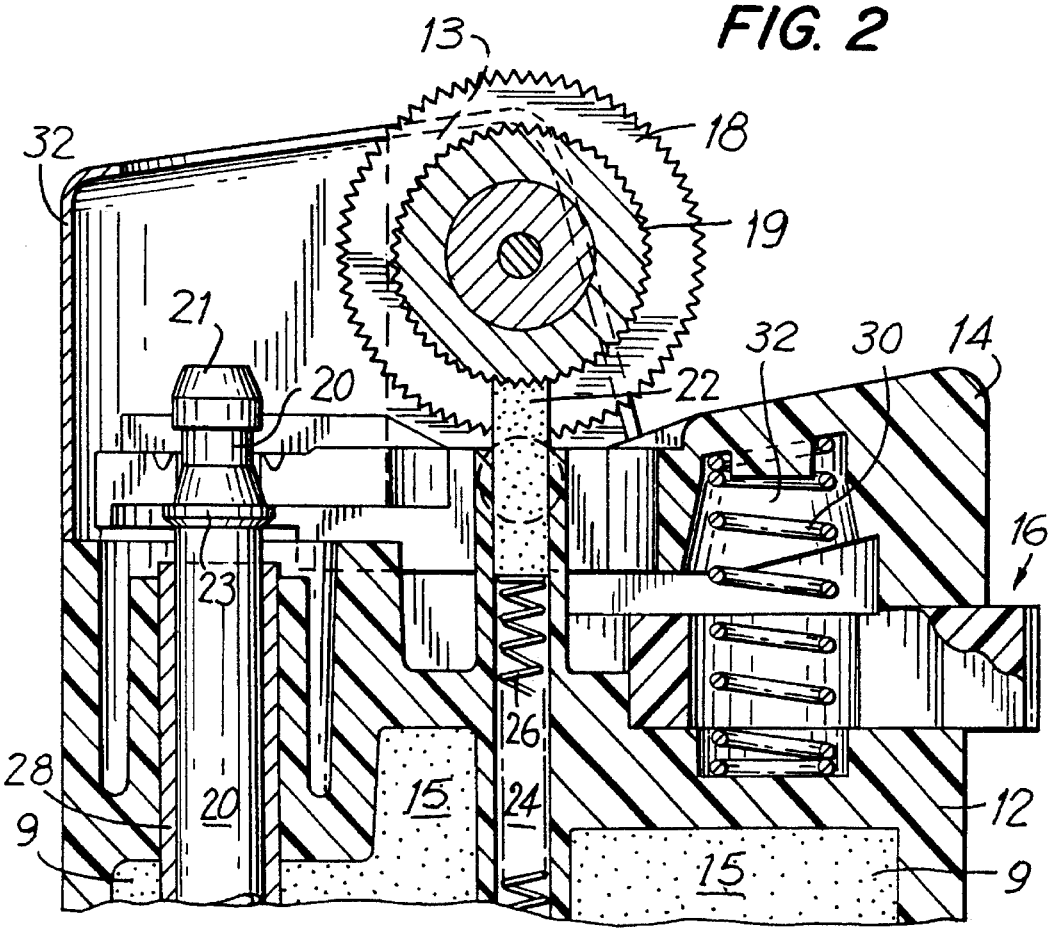
FIG. 2 is a fragmentary cross-sectional view along line 2—2 of the child resistant lighter of FIG. 1 depicting the lighter in a locked position.

Referring now to FIG. 2, there is depicted a cross-section of the lighter of FIG. 1 in a locked position. More particularly, valve actuator 14 is pivotally mounted between side wall portions 13 which comprise extensions of the side walls of body portion 12. Valve actuator 14 is attached to hollow fuel nozzle 20 slidably supported within valve housing 28. Hollow fuel nozzle 20 is held within a bore in valve actuator 14 by flanges 21,23 having sufficient diameter to prevent slippage through the bore in valve actuator 14. A compressed spring 30 resides partially within a recess 32 in valve actuator 14 and causes fuel nozzle 20 to be urged downward into valve housing 28 and body portion 12. In such an embodiment, valve actuator 14 is employed to lift nozzle 20 in order to expel fuel. Alternatively, actuation of valve actuator 14 may serve to remove the pressure maintaining the valve nozzle in a closed position. A conventional valve assembly (not shown) is located near the recessed end of nozzle 20 and permits fuel flow through nozzle 20 only when valve actuator 14 is depressed.

Lighter 10 further comprises a sparking flint 22 mounted within a bore 24 in main body 12. Flint 22 is urged toward spark-producing wheel 18 by spring 26. Sparking wheel 18, which includes a toothed surface 19 which is preferably suitably hardened and against which flint 22 is urged, is mounted for rotation between side wall extension portions 13 in a conventional manner. The spark-producing wheel includes suitable indentations which define teeth such that when the wheel is rotated the toothed surface cuts against flint 22 causing the generation of ignition sparks.

Main body 12 defines an internal chamber 15 which is filled with a fuel 9 such as butane fuel capable of vaporizing in a conventional manner to produce a gaseous medium which passes through a fuel nozzle 20 under the control of a valve. Main body 12 is constructed from any suitable structural material and is preferably constructed from a plastic material. Polyacetal is preferred. However, such alternative materials as styrene acrylonitrile, polyester, nylon or the like may also be used. A preferably metallic shield 32 is provided to function as a wind guard around the flame thereby assisting in the ignition of the fuel.

As depicted in FIG. 1 a notched opening 21 is provided in body portion 12 to accommodate valve actuator 14 and safety latch 16 and, in particular, cross-wise movement of safety latch 16. As will be appreciated, the locked configuration of the lighter in FIGS. 1 and 2 in which safety latch 16 is positioned directly beneath valve actuator 14 prevents depression of valve actuator 14, thereby preventing operation of the lighter.

Figure 3:
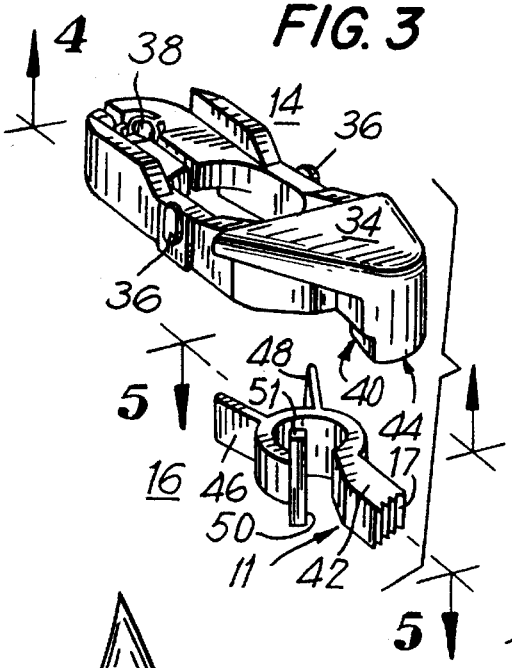
FIG. 3 is an exploded view of a valve actuator and safety latch depicted in FIGS. 1 and 2.

Referring now to FIG. 3, there is depicted valve actuator 14 and safety latch 16 In greater detail. Valve actuator 14 comprises a finger depressable surface 34, extensions 36, a bore 38 and a stepped, or guide, notch 40. A user desiring to actuate the lighter depresses finger depressable surface 34. Extensions 36 are provided to matingly engage with bores in side wall portions 13 of body portion 12 to provide pivotal movement of the valve actuator. Bore 38 is adapted for receiving and grasping a portion of fuel nozzle 20. As will be appreciated, stepped notch 40 is provided for engagement with an upper surface of finger actuated portion 11 of safety latch 16 during actuation of the lighter. In the locked or closed configuration depicted in FIGS. 1 and 2, an upper surface 42 of portion 11 of safety latch 16 is flush against a lower surface 44 of valve actuator 14, and a lower surface of portion 11 of safety latch 16 is flush against a section of body 12 formed by notch 21, thereby preventing depression of valve actuator 14.

Safety latch 16 is provided with pivoting extensions 46,48 which facilitate deflection and stabilization of safety latch 16 within body portion 12 and assures proper positioning and retention of safety latch 16 in notched opening 21 when the safety latch is compressed. Safety latch 16 is also provided with a limiting stop 50 for engagement against a section of body portion 12 formed by notch 21 (FIG. 1) in order to facilitate, in conjunction with forces provided by pivoting extensions 46 and 48, resilient movement of finger actuated portion 11 with respect to limiting stop 50. Limiting stop 50 is preferably provided with a tip section 51 to facilitate retaining safety latch 16 in the unlocked positions. Safety latch 16 may be provided with ridged surface 17 to provide frictional resistance with a user's finger to facilitate movement of finger actuated portion 11 with respect to limiting stop 50.

Referring now to FIG. 4, there is depicted a view of the underside of valve actuator 14 along line 4—4 in FIG. 3. Recess 32 is adapted to receive spring 30 as depicted in FIG. 2 and may take on a variety of forms such as a simple indentation or a bore having a center pin 54, extensions 56 and a chamfered edge 58. Insertion of the fuel nozzle into bore 38 of valve actuator 14 is facilitated by not 39 which permits expansion of bore 38 to easily receive the fuel nozzle. Valve actuator 14 is constructed from materials having sufficient dimensional stability and rigidity to continuously assure proper relative positioning between lower surface 44 of valve actuator 14 and upper surface 42 of safety latch 16. Actuator 14 is preferably constructed of glass filled polyetherimide. Other illustrative materials from which valve actuator 14 may also be constructed are zinc, brass, aluminum and other glass filled polymers such as polysulfone, polyester or the like.

Referring to FIG. 5, there is illustrated a view of the topside of safety latch 16 taken along line 5—5 in FIG. 3 safety latch 16 is preferably constructed of polyetherimide. It is necessary that the material from which latch 16 is constructed is a relatively rigid material which is sufficiently resilient to permit movement of finger actuated portion 11 towards limiting stop 50 so as to at least partially close the opening thereinbetween and provide resilient movement of finger actuated portion 11 with respect to limiting stop 50. Illustrative of alternative materials from which safety latch 16 may be constructed include polysulfone, polyester, or any sufficiently resilient metal or elastomer, as well as a wide variety of other suitable materials.

FIG. 6 schematically depicts a piezoelectric type lighter in which the present invention may be employed. The piezoelectric lighter comprises hammer means 60, spark and fuel providing means 65, electrical cut-off safety switch 70 and locking means 75. The piezoelectric lighter operates in a conventional manner except for depression of hammer means 60 which is prevented by inclusion of locking means 75 operative on the fuel supply in accordance with the present invention. Illustratively, such a locking means comprises a safety latch and a valve actuator which preferably prevent the flow of fuel as previously described, as well as preventing the production of sparks. Alternatively, the locking means may be arranged to selectively prevent only the flow of fuel or it may be arranged to selectively prevent the production of sparks.

Figure 7:
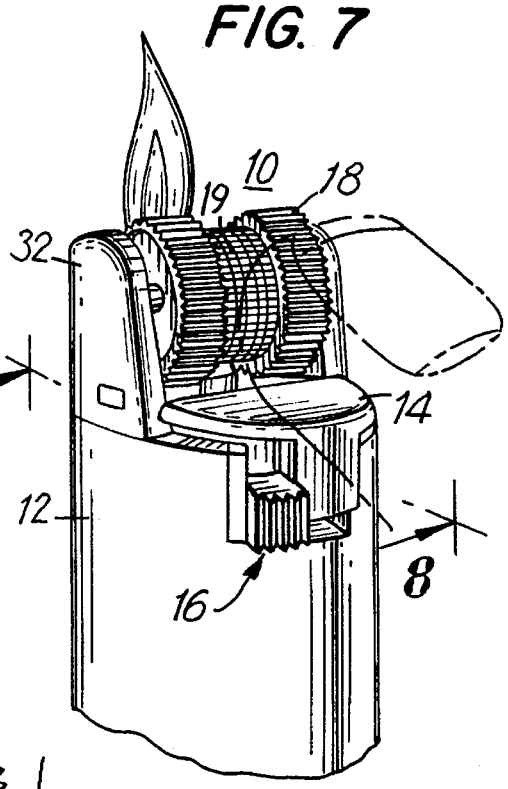
FIG. 7 is a perspective view of a preferred embodiment of the child resistant lighter in an unlocked position in which the position of the safety latch is moved from its at-rest position and the valve actuator is depressed allowing a valve to be opened and to release gas through a valve nozzle.

In operation of the present invention, and as depicted in FIG. 7, a user must first move safety latch 16 in a direction so as to sufficiently displace finger actuated portion 11 of safety latch 16 toward limiting stop 50 of safety latch 16 to ultimately permit depression of valve actuator 14. However, in order to facilitate retention of safety latch 16 in such a displaced position, safety latch 16 is then displaced in a direction such that a portion of finger actuated portion 11 of safety latch 16 abuts notch 40 of valve actuator 14, and tip section 51 is displaced to just above body portion 12. Depression of valve actuator 14 at this point combined with rotation of spark-producing wheel 18 will cause the lighter to operate. In particular, the sparks thus produced will ignite the gaseous fuel which is permitted to be expelled from nozzle 20 when valve actuator 14 lifts nozzle 20 thereby actuating the valve. The lifting action of valve actuator 14 in a vicinity near nozzle 20 relieves the pressurized condition in the fuel chamber thereby permitting the flow of fuel as a gaseous medium through nozzle 20 to be burned.

Figure 8:
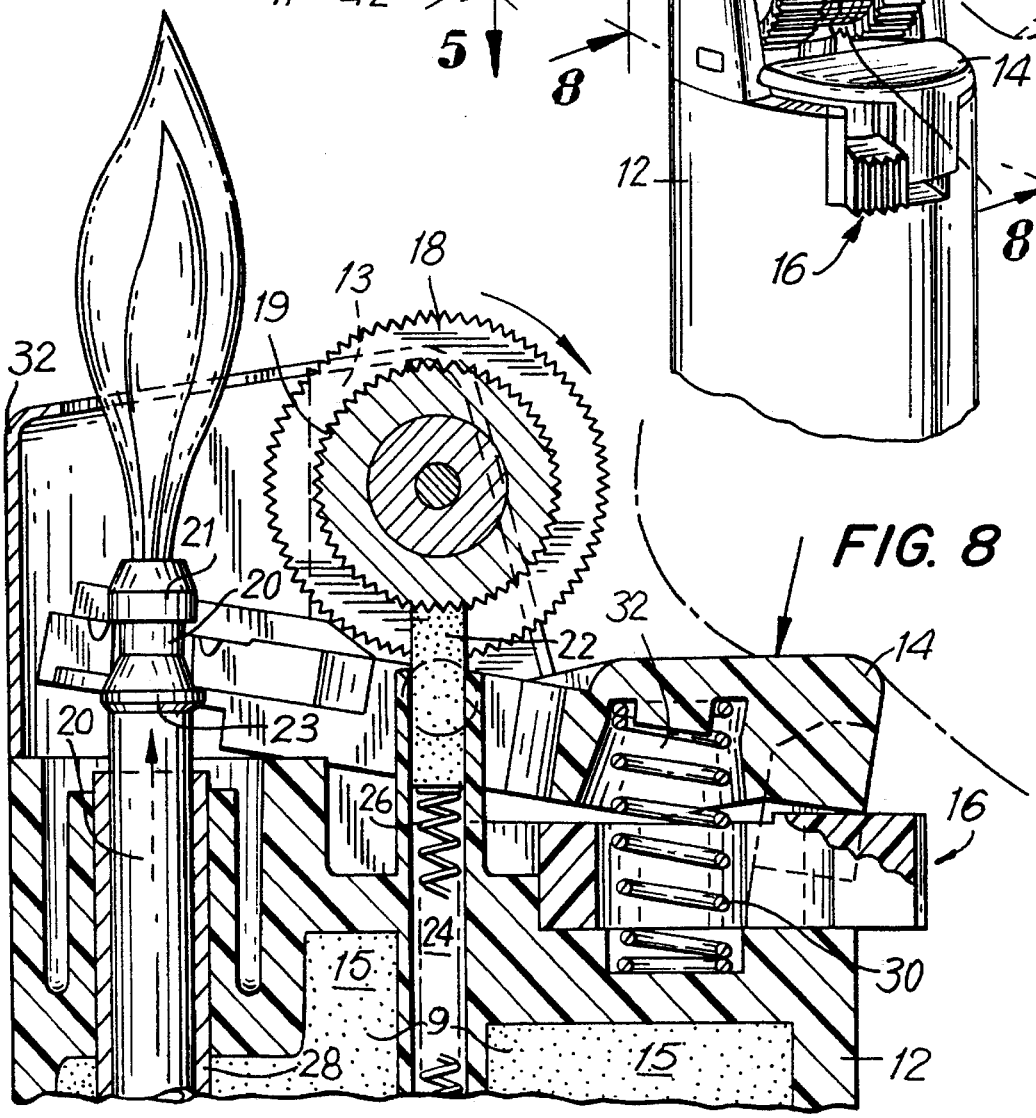
FIG. 8 is a fragmentary cross-sectional view along line 8—8 of FIG. 7 depicting the lighter in an unlocked and depressed position.

Referring now to FIG. 8, there is depicted a cross-section of the lighter of FIG. 7 in a depressed and actuated configuration. As will be appreciated, movement of finger actuated portion 11 of safety latch 16 toward limiting stop 50 of safety latch 16 will permit unimpeded depression of the valve actuator as depicted in FIGS. 7,8.

In particular, such movement of safety latch 16 followed by depression of valve actuator 14 will cause spring 30 to depress and fuel nozzle 20 to be urged upward and partially out of valve housing 28 and body portion 12. Such lifting of fuel nozzle 20 upward will permit fuel to flow from chamber 15 through the valve (not shown) and out of nozzle 20 whereupon it will have been ignited by sparks produced by flint 22 and toothed surface 19 of spark-producing wheel 18. Hollow fuel nozzle 20 is held within bore 38 in valve actuator 14 by flanges 21,23 having sufficient diameter to assure proper movement of the nozzle within valve housing 28.

FIGS. 9–13 depict the sequence of operations required for the locking and unlocking of the lighter. In particular, FIG. 9 depicts safety latch 16 and valve actuator 14 in an at-rest locked position. In this position, depression of valve actuator 14 by finger pressure on surface 34 is prevented by contact with surface 42 of finger actuated portion 11 of the safety latch. Finger actuated portion 11 is positioned directly beneath the underside of valve actuator 14.

Figure 10:
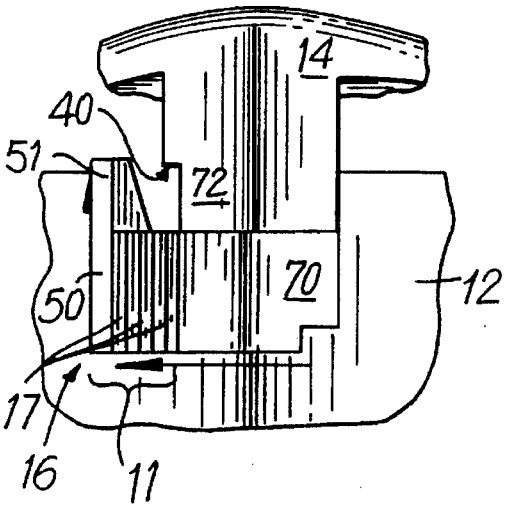
FIG. 10 is a frontal view of the safety latch in a partially unlocked position.

FIG. 10 depicts safety latch 16 in a partially unlocked position and valve actuator 14 in an undepressed position. Portion 11 of safety latch 16 has been moved in a direction indicated by the arrow, providing a void 70 into which a portion 72 of valve actuator 14 may be subsequently inserted. As depicted, portion 11 of safety latch 16 is under compressive loading. Absent any holding pressure on portion 11 in the position depicted in FIG. 10, portion 11 will return to its at-rest position depicted in FIG. 9.

Figure 11:
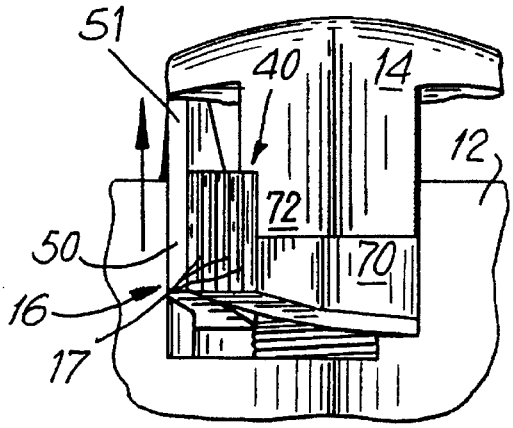
FIG. 11 is a frontal view of the safety latch in its unlocked position.

FIG. 11 depicts safety latch 16 and valve actuator 14 in an unlocked configuration ready for depression of valve actuator 14. Portion 11 of safety latch 16 has been moved upwards in a direction indicated by the arrow towards stepped, or guide, notch 40 of valve actuator 14. Limiting stop 50, which also forms part of safety latch 16, has also been moved upwards by applying force to portion 11 as indicated by the arrow. Advantageously, due to the compressive loading which safety latch 16 is under when portion 11 is approximately adjacent to limiting stop 50 (FIGS. 10,11), removal of holding pressure from portion 11 once portion 11 has been inserted towards notch 40 (FIG. 11) will not result in portion 11 slipping toward void 70 but will maintain the lighter in the configuration depicted in FIG. 11, Until valve actuator 14 is depressed. Retention of safety latch 16 in the unlocked configuration may be facilitated by moving limiting stop 50 upwards a distance sufficient to position tip section 51 of limiting stop 50 just above body portion 12 as indicated in FIG. 11.

Figure 12:
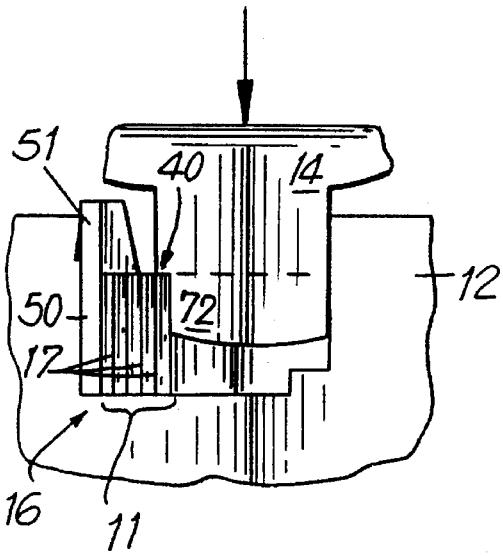
FIG. 12 is a frontal view of the safety latch in its unlocked position and the valve actuator depressed so as to permit the flow of fuel.

Application of finger pressure to valve actuator 14 as depicted in FIG. 11 will yield the configuration depicted in FIG. 12 in which valve actuator 14 has been depressed thereby permitting fuel to flow through the valve and fuel nozzle (not shown). In particular, as valve actuator 14 is depressed, notch 40 of the valve actuator facilitates the urging of safety latch 16 towards its locked position. Provided that spark-producing wheel 18 (FIG. 7) was actuated in combination with valve actuator 14 being depressed, the fuel flowing through the fuel nozzle will be ignited. Such fuel will continue to flow and burn as long as sufficient pressure is maintained on valve actuator 14.

Figure 13:
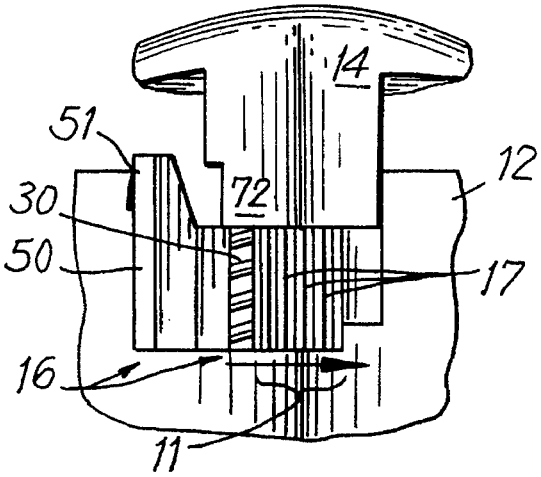
FIG. 13 is a frontal view of the safety latch in its locked position.

Once pressure is removed from valve actuator 14, the valve actuator will move upward due to the biasing force provided by spring 30 as indicated in FIG. 13, and the flame will be extinguished. Advantageously, as valve actuator 14 moves upward, safety latch 16 remains in the down position in void 70 since frictional forces between portion 11 and actuator 14 are less than the forces required to lift the safety latch and overcome, inter alia, such forces as those required to deflect extensions 46,48. Once valve actuator 14 moves upward a sufficient amount, portion 11 moves in the direction indicated by the arrow in FIG. 13 towards its at-rest position.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the locking mechanism and lighter disclosed and claimed herein are not limited to use in disposable lighters. Additionally, a flame height adjusting mechanism may be provided to selectively adjust the height of the flame. Moreover, the present invention is in no way limited to,a locking mechanism in which a safety latch is moved first in a cross-wise direction then in an upwards direction ninety degrees from the cross-wise direction in order to provide a void into which a valve actuator may be depressed. For example, any of a wide variety of locking mechanisms or actions may be employed, such as mechanisms having right-left, front-rear, over and down, in and over, etc. type actions. Although it has been found that the present embodiment as described may be used by both right and left handed users, the positioning and direction of movement of elements may be reversed.

What is claimed is:

1. A lighter having a fuel cutoff mechanism, said mechanism comprising:

a depressible valve actuator pivotably mounted on the lighter which, upon depression, actuates a fuel supply thereby permitting fuel to flow out from said fuel supply;

a latch member which is normally positioned beneath a portion of said valve actuator to prevent depression of said depressible valve actuator, said latch member having an integral finger actuatable portion manipulable along a first cross-wise direction and a second direction by a user to a position which permits depression of said valve actuator; and wherein such selective actuation of said fuel supply and a corresponding production of sparks by a spark-producing assembly ignites fuel from said fuel supply, and wherein said cross-wise direction is a direction substantially perpendicular to a longitudinal axis defined by a top end and a bottom end of the lighter.

2. A flame producing lighter which comprises:

a housing for containing a combustible gaseous medium under pressure;

valve means arranged for selective actuation between a normally closed position which prevents exit of said gaseous medium from said housing, and an open position which permits exit of said gaseous medium from said housing through said valve means;

means for selectively producing sparks at a location proximate the gaseous medium exit opening of said valve means thereby selectively causing ignition of said gaseous medium;

a latch member normally in a first position for preventing actuation of said valve means to the open position, said latch member having a body portion and a finger actuatable portion which is movable by application of an external user applied force;

means for selectively moving said latch member to a second position by providing a path along at least two directions for at least a portion of said latch member to travel through wherein actuation of said valve means to the open position is permitted when said latch member is in said second position thereby selectively permitting exit of said combustible gaseous medium from said valve means and ignition of said gaseous medium by sparks produced by said spark producing means; and means for retaining said latch member in said second position by imposing a biasing force on said latch member when in said second position, said latch member being retained in said second position at least until said valve means is moved to the open position.

3. The flame producing lighter according to claim 2 wherein said latch member having a body portion is provided with first and second extensions projecting away from said body portion.

4. A flame producing lighter which comprises:

a housing for containing a combustible gaseous medium under pressure;

a valve mounted on the housing and selectively actuatable between a closed position which prevents exit of said gaseous medium from said housing, and an open position which permits exit of said gaseous medium from said housing through said valve;

a depressible valve actuator mounted on the housing and cooperating with said valve to selectively actuate said valve between the closed position and the open position;

means for selectively producing sparks at a location proximate said valve in the open position, thereby selectively causing ignition of said gaseous medium; and a latch member separate from and cooperating with the valve actuator, said latch member having an integral body portion and an integral finger actuatable portion which is movable along at least two directions between a first default position in which actuation of said valve to the open position by said valve actuator is prevented, and a second position in which actuation of said valve by said valve actuator is permitted, said finger actuatable portion being movable from said default position to said second position only by application of an external user applied force, said latch member being biased such that said finger actuatable portion is returnable automatically from said position to said default position after said valve is actuated to the open position.

5. The flame producing lighter according to claim 4 wherein said latch member body portion is provided with first and second extensions projecting away from said body portion.

6. A flame developing lighter, comprising:

a housing;

fuel supply means for supplying fuel to be ignited;

ignition means for igniting said fuel;

valve means for selectively permitting flow of said fuel proximate the ignition provided by said ignition means;

a valve actuator which normally prevents escape of said fuel from said fuel supply means when in a first position and is depressible to a second position which permits actuation of said fuel supply means thereby permitting fuel to flow out from said fuel supply means; and a latch member which normally prevents depression of said depressible valve actuator, at least a portion of said latch member being normally positioned between at least a portion of said valve actuator and at least a portion of said housing, thereby preventing depression of said valve actuator, wherein said latch member is movable by selective application of a force in a cross-wise direction and another force in another direction by the operator to said latch member to provide a void between said valve actuator and said housing, said void being sufficient in size to enable said valve actuator to be depressed at least partially into said void, said cross-wise direction being within a plane which is substantially perpendicular to a longitudinal axis defined between a top end and a bottom end of said lighter.

7. The flame developing lighter according to claim 6 wherein said latch member is actuatable by a user's finger.

8. A lighter having a fuel cutoff mechanism, said mechanism comprising:

a depressible valve actuator pivotably mounted on the lighter which, upon depression, actuates a fuel supply thereby permitting fuel to flow out from said fuel supply;

a latch member which is normally positioned beneath a portion of said valve actuator to prevent depression of said depressible valve actuator, said latch member having an integral finger actuatable portion wherein said integral finger actuatable portion is movable in two directions upon application of a suitable biasing force along two directions by a user to said finger actuatable portion to a position which permits depression of said valve actuator; and wherein such selective actuation of said fuel supply and a corresponding production of sparks by spark-producing means ignites fuel from said fuel supply.

9. The fuel cutoff mechanism according to claim 8 wherein at least a portion of said finger actuatable portion is normally positioned between said valve actuator and a main body housing of said lighter thereby preventing depression of said valve actuator.

10. The fuel cutoff mechanism according to claim 9 wherein cross-wise movement of said finger actuatable portion provides a void between said valve actuator and said main body housing,. said void being sufficient in size to enable said valve actuator to be depressed at least partially into said void, said movement being within a plane which is substantially perpendicular to a longitudinal axis defined between a top end and a bottom end of said lighter.

* * * * *